US005139442A

United States Patent [19]

Sakamoto et al.

[11] Patent Number: 5,139,442

[45] Date of Patent: Aug. 18, 1992

[54] MODULAR JACK

[75] Inventors: Yukio Sakamoto; Iwao Fukutani; Toshio Hori, all of Nagaokakyo, Japan

[73] Assignee: Murata Manufacturing Co., Ltd., Nagaokakyo, Japan

[21] Appl. No.: 801,422

[22] Filed: Dec. 2, 1991

[30] Foreign Application Priority Data

Dec. 3, 1990 [JP] Japan ..... 2-400240
Dec. 7, 1990 [JP] Japan ..... 2-400774

[51] Int. Cl.[5] ..... H01R 13/66
[52] U.S. Cl. ..... 439/620; 439/676
[58] Field of Search ..... 439/620, 676; 333/181-185; 361/329

[56] References Cited

U.S. PATENT DOCUMENTS 4,695,115 9/1987 Talend ..... 439/676 X
4,772,224 9/1988 Talend ..... 439/620 X
4,795,991 1/1989 Saito et al. ..... 439/620 X
5,015,204 5/1991 Sakamoto et al. ..... 439/620
5,069,641 12/1991 Sakamoto et al. ..... 439/620

*Primary Examiner*—Eugene F. Desmond
*Attorney, Agent, or Firm*—Burns, Doane, Swecker & Mathis

[57] ABSTRACT

A modular jack incorporating a varistor. The varistor reduces noise and surge (abnormal voltage) entering the modular jack, and thereby an electronic appliance such as a telephone connected with the modular jack is not affected by the noise and surge. The varistor is electrically connected between at least a pair of contact leads. Alternatively the varistor is electrically connected between the pair of contact leads and a grounding terminal. Further, the modular jack incorporates a common mode choke coil so as to obtain a common mode noise reduction effect.

5 Claims, 6 Drawing Sheets

MODULAR JACK

BACKGROUND OF THE INVENTION

1. Field of the Invention

The present invention relates to a modular jack which is a connector employed in an electronic appliance such as a telephone and a facsimile.

2. Description of Related Art

Generally, a modular jack employed in an electronic appliance such as a telephone cooperates with a varistor which protects the electronic appliance from noise and surge (abnormal voltage).

However, conventionally, the modular jack and the varistor are separate parts, and the varistor is fastened to a circuit board such as a printed board on which the modular jack is mounted. In this case, conductive patterns are required to connect the parts with each other, and the conductive patterns consume space. Thus the modular jack/varistor unit is hard to be made compact.

SUMMARY OF THE INVENTION

An object of the present invention is to provide a compact modular jack which functions as a connector and also as a varistor to protect an electronic appliance from noise and surge.

In order to attain the object, a modular jack according to the present invention comprises: an insulating housing; at least a pair of contact leads fixed to the housing; and a varistor disposed in the housing. The pair of contact leads serves at least as a pair of contactors with a plug or as a pair of contact legs with a circuit board.

Since the varistor is contained in the housing, conductive patterns for connecting separate parts are not required. Hence the modular jack having the built-in varistor can be made compact, compared with a conventional modular jack/varistor unit.

Further, the varistor is electrically connected between the pair of contact leads, and the modular jack of the structure is easy to assemble.

Another modular jack according to the present invention comprises: an insulating housing; at least a pair of contact leads fixed to the housing; a grounding terminal fixed to the housing; and a varistor disposed in the housing in such a manner to be nipped and electrically connected between the grounding terminal and the pair of contact leads.

Since the varistor is contained in the housing and electrically connected between the grounding terminal and the pair of contact leads, conductive patterns for connecting separate parts are not required. Hence the modular jack having the built-in varistor can be made compact, compared with a conventional modular jack-/varistor unit.

Further, when a common mode choke coil is connected with the pair of contact leads, the modular jack obtains a further effect of reducing common mode noise.

BRIEF DESCRIPTION OF THE DRAWINGS

This and other objects and features of the present invention will become apparent from the following description in connection with preferred embodiments thereof in reference to the accompanying drawings in which.

DETAILED DESCRIPTION OF THE PREFERRED EMBODIMENTS

Some embodiments of the present invention are hereinafter described in reference to the accompanying drawings. In the embodiments, the same components and portions are referenced by the same numbers and marks.

Figure 1:
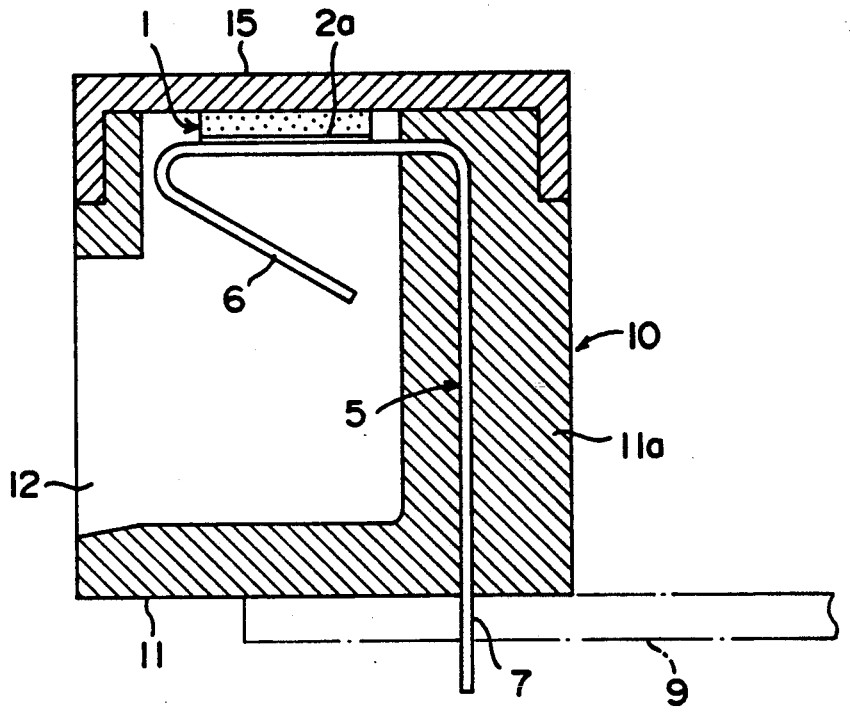
FIG. 1 is an elevational view in section of a modular jack of a first embodiment.
Figure 2:
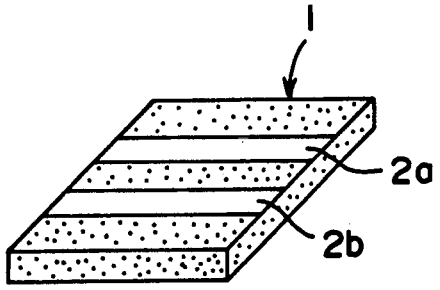
FIG. 2 is a perspective view of a varistor to be incorporated in the modular jack shown in FIG. 1, viewed from a side with electrodes.
Figure 3:
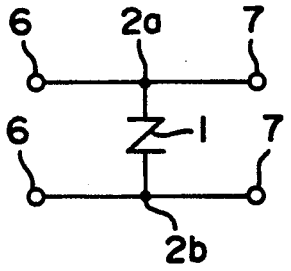
FIG. 3 is a diagram of an equivalent electric circuit of the modular jack shown in FIG. 1.

First Embodiment: FIGS. 1-3

FIG. 1 shows a modular jack comprising a varistor 1, two contact leads 5 (only one of them is shown in FIG. 1) and an insulating housing 10. The contact leads 5 pierce through the housing 10. The housing 10 integrated with the contact leads 5 is made by insert-molding wherein the contact leads 5 are inserted in a mold of the housing 10 before resin is injected into the mold. The varistor 1, as shown in FIG. 2, is rectangular, and electrodes **2*a* and 2*b* which are extended in parallel with each other are formed on a side of the varistor 1 by printing or the like, which side is to come into contact with the contact leads 5. The varistor 1 is made of, e.g., zinc oxide, barium titanate, strontium titanate or the like, and the electrodes 2*a* and 2*b*** are made of, e.g., copper, silver, a compound of silver with palladium or the like.

Each of the contact leads 5 is shaped like a reversed L. The contact leads 5 each has an end 6 serving as a contactor with a plug, and an end 7 serving as a contact leg with a circuit board 9. The contact leads 5 are made of a conductive and elastic material such as phosphor bronze. Further, although only one contact lead 5 is shown in FIG. 1, the other contact lead 5 is juxtaposed with the shown contact lead 5.

The housing 10 is made of resin and consists of a body 11 and a lid 15. The contact leads 5 are embedded in a wall **11*a* of the body 11 by insert-molding, and protrude the contactors 6 and the contact legs 7** from the body 11. The body 11 has an opening 12, and a plug is inserted in the opening 12 and comes into contact with the contactors 6.

The varistor 1 is disposed on the contactors 6 of the two contact leads 5 in such a manner that the electrodes 2a and 2b are in contact with the contactors 6 respectively. Then the lid 15 is mounted on the body 11, and the varistor 1 is nipped between the lid 15 and the contact leads 5. Preferably, the electrodes 2a and 2b of the varistor 1 are soldered to the contact leads 5 respectively so that electrical connection between the contact leads 5 and the varistor 1 can be ensured.

FIG. 3 shows an equivalent electric circuit of the modular jack of the above structure. Noise and surge received by the contactors 6 of the contact leads 5 are attenuated by the varistor 1. Thereby the noise and surge transmitted to the contact legs 7 are in an insignificant level, and an electronic appliance such as a telephone which is connected with the modular jack through the contact legs 7 is not affected by the noise and surge.

The modular jack which incorporates the varistor 1 requires no conductive patterns. Thus a compact modular jack which also functions as a varistor can be obtained.

Figure 4:
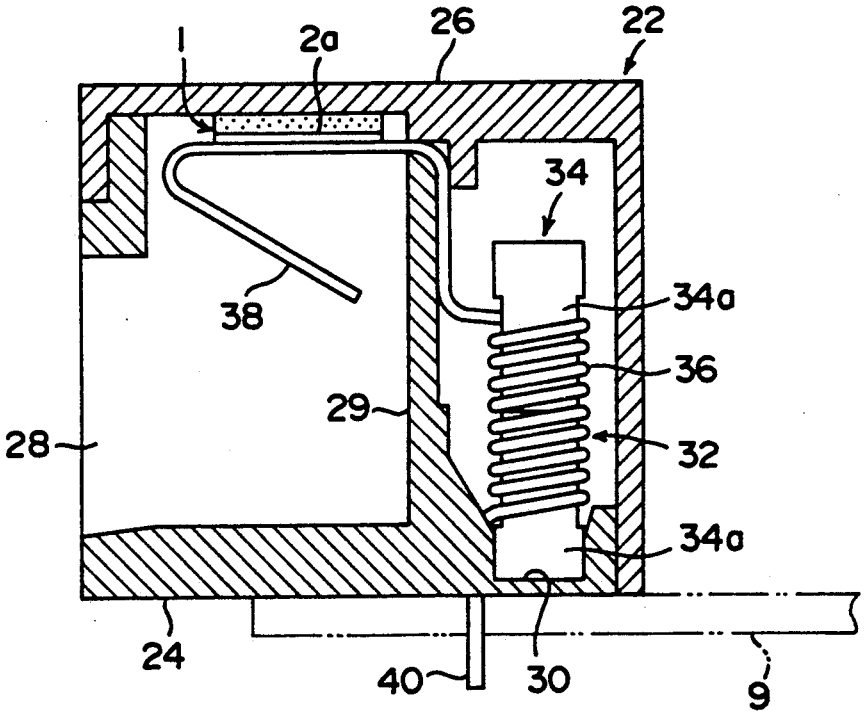
FIG. 4 is an elevational view in section of a modular jack of a second embodiment.
Figure 6:
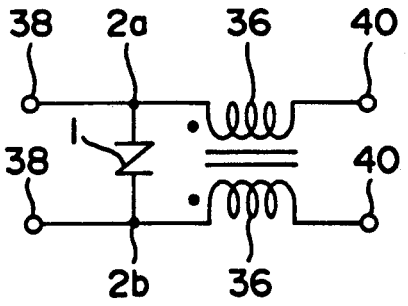
FIG. 6 is a diagram of an equivalent electric circuit of the modular jack shown in FIG. 4.

Second Embodiment: FIGS. 4 6

FIG. 4 shows a modular jack containing not only a varistor but also a common mode choke coil for reducing common mode noise.

The modular jack has a resin housing 22 consisting of a body 24 and a lid 26. The body 24 has a wall 29 which separates the inside of the body 24 into a front room (left in FIG. 4) and a rear room (right in FIG. 4). The front room is for a plug which is inserted through the opening 28. In the rear room, a common mode choke coil 32 is disposed. The bottom of the common mode choke coil 32 is engaged with a recession 30 formed on the bottom of the body 24.

Figure 5:
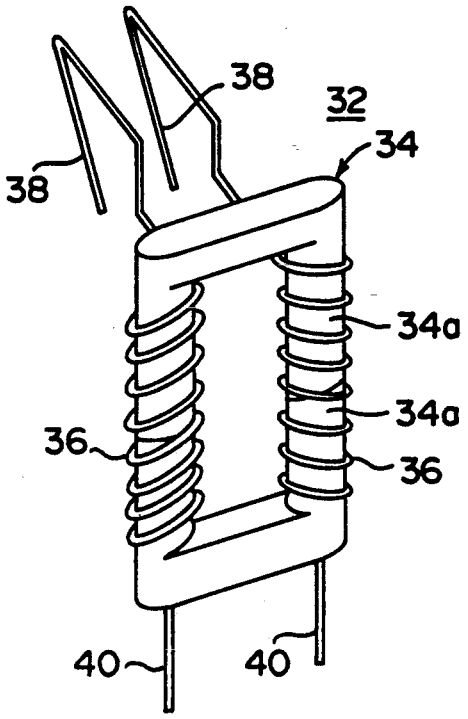
FIG. 5 is a perspective view of a common mode choke coil to be incorporated in the modular jack shown in FIG. 4.

FIG. 5 shows the common mode choke coil 32. The choke coil 32 has a ring core 34 formed by two U-shaped cores 34a, and two coils 36 are coiled around longitudinal poles of the ring core 34 respectively in the opposite direction. As shown in FIG. 4, each of the coils 36 extends its one end to the front room and protrudes the other end from the bottom of the body 24. The former end 38 serves as a contactor with a plug, and the latter end 40 serves as a contact leg with the circuit board 9.

The varistor 1 is disposed on the contactors 38 of the coils 36 in such a manner that the electrodes 2a and 2b are in contact with the contactors 38 respectively. Then the lid 26 is mounted on the body 24, and the varistor 1 is nipped between the lid 26 and the contactors 38.

FIG. 6 shows an equivalent electric circuit of the modular jack. Since this modular jack contains the common mode choke coil 32, it has a common mode noise reduction effect as well as the effects of the modular jack of the first embodiment. Common mode noise received by the two contactors 38 is reduced by the common mode choke coil 32, and very little common mode noise is transmitted to the contact legs 40. Further, since the choke coil 32 is disposed downstream of the varistor 1, the choke coil 32 is not required to have a large current carrying capacity.

Third Embodiment: FIGS. 7-11

Figure 7:
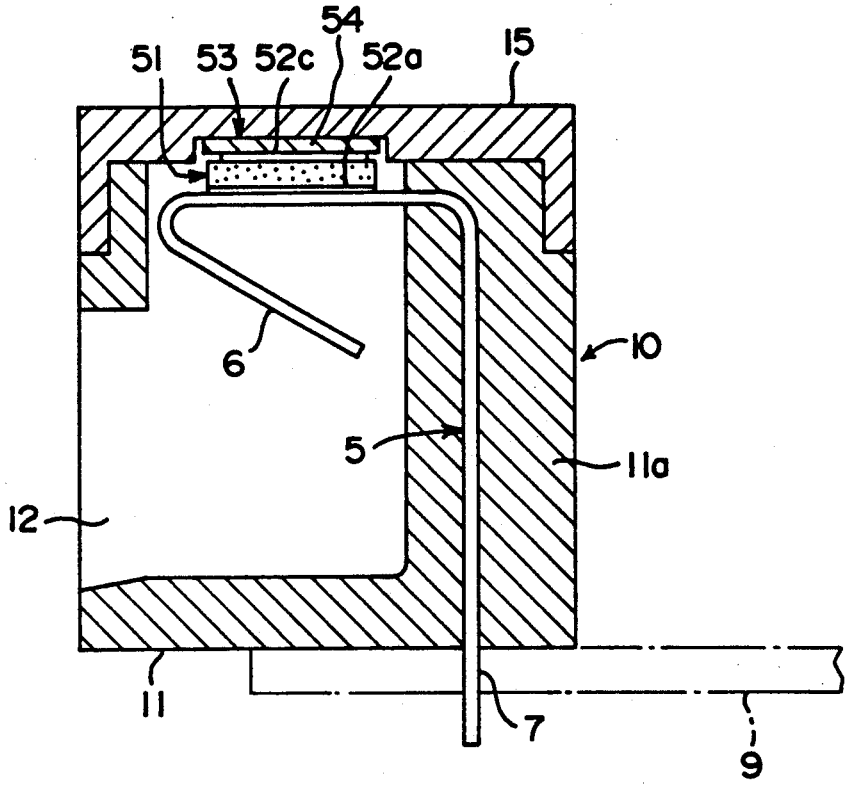
FIG. 7 is an elevational view in section of a modular jack of a third embodiment.
Figure 8:
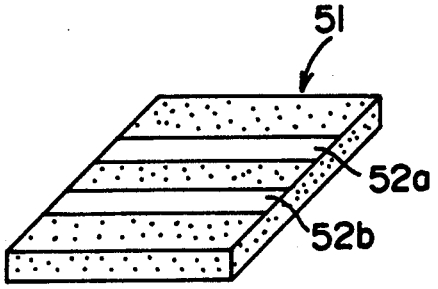
FIG. 8 is a perspective view of a varistor to be incorporated in the modular jack shown in FIG. 7, viewed from a side to come into contact with contact leads.
Figure 9:
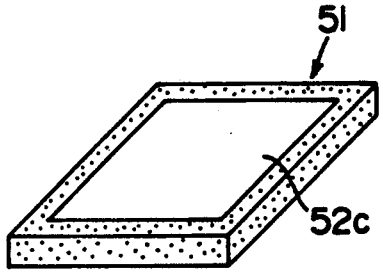
FIG. 9 is a perspective view of the varistor, viewed from a side to come into contact with a grounding terminal.

FIG. 7 shows a modular jack comprising a varistor 51, the two contact leads 5 (only one of them is shown in FIG. 7), a grounding terminal 53 and the housing 10. The contact leads 5 and the grounding terminal 53 are fixed to the housing 10 by insert-molding. The varistor 51, as shown in FIGS. 8 and 9, is rectangular. Electrodes 52a and 52b which are extended in parallel with each other are formed on a side of the varistor 51 by printing or the like, which side is to come into contact with the contact leads 5. Also, an electrode 52c is formed on the almost entire surface of the other side of the varistor 51, which side is to come into contact with the grounding terminal 53.

Figure 10:
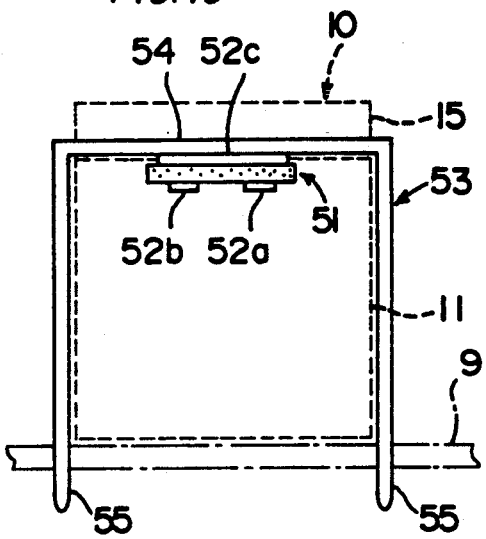
FIG. 10 is a front elevational view showing the varistor and the grounding terminal shown in FIG. 7.

Referring to FIG. 10, the grounding terminal 53 comprises a body 54 for electrical connection with the varistor 51 and legs 55 for electrical connection with the circuit board 9. The grounding terminal 53 is made of a conductive and elastic material such as phosphor bronze. The grounding terminal 53 is embedded in the lid 15 of the housing 10 by insert-molding. The center of the body 54 shows on an inner surface of the lid 15. The legs 55 are protruded from both sides of the lid 15 and extended along sides of the body 11.

The varistor 51 is disposed on the contactors 6 of the contact leads 5 in such a manner that the electrodes 52a and 52b are in contact with the contactors 6 respectively. Then the lid 15 is mounted on the body 11, and the varistor 51 is nipped between the lid 15 and the contact leads 5. Further, soldering of the electrodes 52a, 52b and 52c to the two contact leads 5 and the grounding terminal 53 respectively ensures electrical connection.

Figure 11:
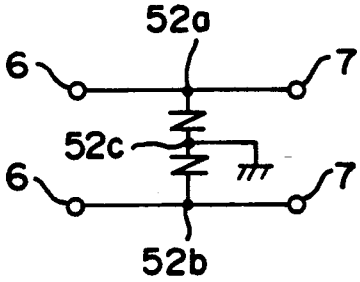
FIG. 11 is a diagram of an equivalent electric circuit of the modular jack shown in FIG. 7.

FIG. 11 shows an equivalent electric circuit of the modular jack. Noise and surge received by the contactors 6 of the contact leads 5 are attenuated by the varistor 51. Thereby the noise and surge transmitted to the contact legs 7 are in an insignificant level, and an electronic appliance such as a telephone which is connected with the modular jack through the legs 7 is not affected by the noise and surge.

The modular jack which incorporates the varistor 51 requires no conductive patterns. Thus a compact modular jack which also functions as a varistor can be obtained.

Figure 12:
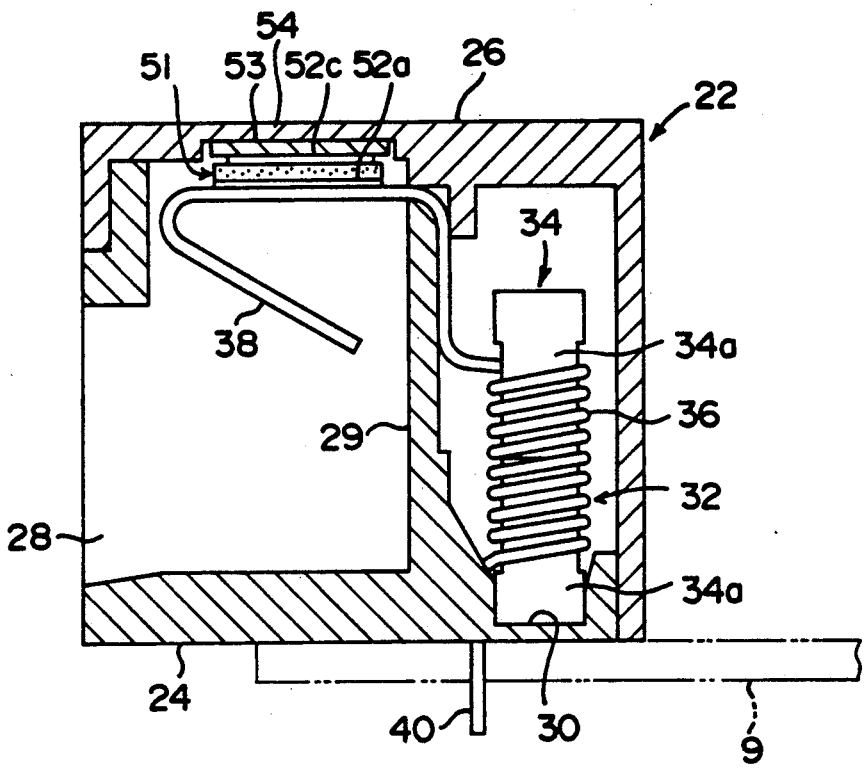
FIG. 12 is an elevational view in section of a modular jack of a fourth embodiment.
Figure 13:
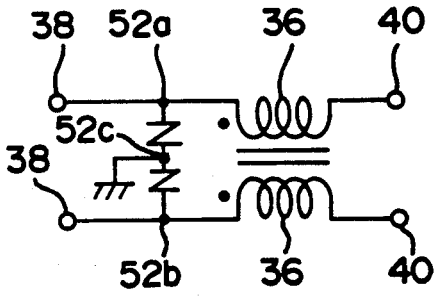
FIG. 13 is a diagram of an equivalent electric circuit of the modular jack shown in FIG. 12.

Fourth Embodiment: FIGS. 12 and 13

FIG. 12 shows a modular jack containing not only a varistor but also a common mode choke coil for reducing common mode noise.

The grounding terminal 53 is embedded in the lid 26 of the housing 22 by insert-molding. The center of the body 54 of the grounding terminal 53 shows on the inner surface of the lid 26. The legs 55 (not shown) of the grounding terminal 53 are protruded from both sides of the lid 26 and extended along sides of the body 24.

The varistor 51 is disposed on the contactors 38 of the two coils 36 in such a manner that the electrodes 52a and 52b are in contact with the contactors 38 respectively. Then the lid 26 is mounted on the body 24, and the varistor 51 is nipped between the body 54 of the grounding terminal 53 and the contactors 38.

FIG. 13 shows an equivalent electric circuit of the modular jack. The modular jack of the fourth embodiment has a common mode noise reduction effect as well as the effects of the modular jack of the third embodiment. Common mode noise received by the two contactors 38 is reduced by the common mode choke coil 32, and very little common mode noise is transmitted to the legs 40 of the coils 36. Further, since the choke coil 32 is disposed downstream of the varistor 51, the choke coil 32 is not required to have a large current carrying capacity.

Other Embodiments

Although the present invention has been described in connection with the preferred embodiments above, it is to be noted that various changes and modification are apparent to those who are skilled in the art. Such changes and modifications are to be understood as being within the scope of the present invention defined by the appended claims.

The embodiments above described cases wherein two signal lines are used. When more signal lines are used, the number of electrodes formed on a varistor and the number of contact leads shall be increased.

What is claimed is:

1. A modular jack comprising:
an insulating housing;
at least a pair of contact leads fixed to the housing; and
a varistor disposed in the housing.

2. A modular jack as claimed in claim 1, wherein the varistor is electrically connected between the pair of contact leads.

3. A modular jack as claimed in claim 1, wherein a common mode choke coil is connected with the pair of contact leads.

4. A modular jack comprising:
an insulating housing;
at least a pair of contact leads fixed to the housing;
a grounding terminal fixed to the housing; and
a varistor disposed in the housing in such a manner to be nipped and electrically connected between the grounding terminal and the pair of contact leads.

5. A modular jack as claimed in claim 4, wherein a common mode choke coil is connected with the pair of contact leads.

* * * * *